US005275401A

United States Patent [19]

Llorens

[11] Patent Number: 5,275,401

[45] Date of Patent: Jan. 4, 1994

[54] GAME WITH MOBILE FIGURES

[76] Inventor: Edouard F. Llorens, Parc Montvert 1 B - 9, rue des Flots Bleus, 13007 Marseille, France

[21] Appl. No.: 927,634

[22] PCT Filed: Mar. 29, 1991

[86] PCT No.: PCT/FR91/00254

§ 371 Date: Sep. 2, 1992

§ 102(e) Date: Sep. 2, 1992

[87] PCT Pub. No.: WO91/15279

PCT Pub. Date: Oct. 17, 1991

[30] Foreign Application Priority Data

Apr. 4, 1990 [FR] France ..... 90 04617

[51] Int. Cl.[5] ..... A63F 7/06

[52] U.S. Cl. ..... 273/85 B; 273/85 E; 273/85 F; 273/94; 273/126 R

[58] Field of Search ..... 273/85 R, 85 A, 85 B, 273/85 E, 85 F, 94, 86 R, 86 G, 86 H, 126 R, 129 L, 119 R, 108

[56] References Cited

U.S. PATENT DOCUMENTS

| | | | |
|---|---|---|---|
| 1,523,684 | 1/1925 | Canale et al. | 273/85 F X |
| 2,960,339 | 11/1960 | Bush | 273/119 |
| 3,428,316 | 2/1969 | Cane | 273/85 B |
| 3,554,547 | 1/1971 | Vedeen | 273/85 B |
| 3,699,703 | 10/1972 | Biecker | 273/85 B X |
| 4,007,932 | 2/1977 | Lebrun | 273/85 B X |
| 4,033,584 | 7/1977 | Smith | 273/85 E X |
| 4,076,242 | 2/1978 | Joseph | 273/85 B |
| 4,311,309 | 1/1982 | Bradley | 273/85 |
| 4,474,375 | 10/1984 | Stockdale | 273/85 B |

FOREIGN PATENT DOCUMENTS

| | | | |
|---|---|---|---|
| 504703 | 8/1951 | Belgium . | |
| 460218 | 10/1949 | Canada | 273/85 F |
| 680009 | 8/1939 | Fed. Rep. of Germany . | |
| 1061245 | 4/1954 | France . | |
| 2068972 | 9/1971 | France . | |
| 2148723 | 6/1985 | United Kingdom | 273/85 B |
| 2175810 | 12/1986 | United Kingdom | 273/85 B |

*Primary Examiner*—V. Millin
*Assistant Examiner*—Sebastiano Passaniti
*Attorney, Agent, or Firm*—Ladas & Parry

[57] ABSTRACT

A game comprising a board on which figurines can be moved along longitudinal paths by driving mechanisms arranged below the board. The driving mechanisms each comprises at least one handle and connectors for joining the handle to the figurines. The game comprises at least 2 sets of driving mechanisms which can be moved along a longitudinal axis of the board by means of the handles. The handles, which project outwardly from sides of a frame on which the board is mounted, can be moved longitudinally along the frame within slots within the frame sides over a distance equal to about half the frame length.

9 Claims, 8 Drawing Sheets

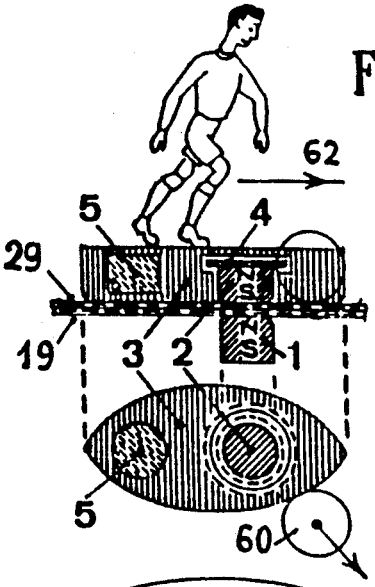
FIG.10a
FIG.10b
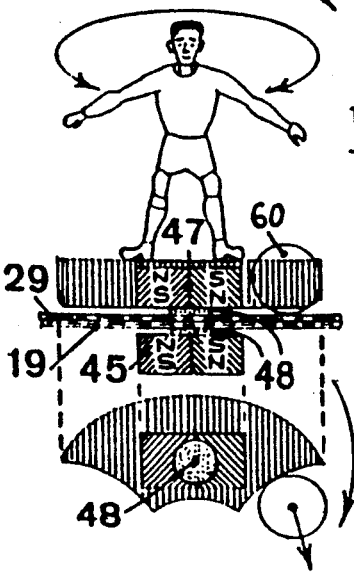
FIG.11a
FIG.11b
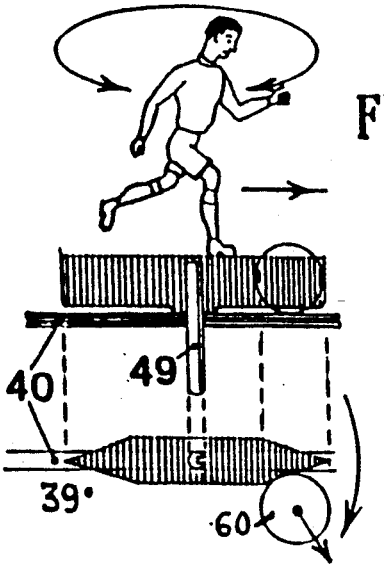
FIG.12a
FIG.12b
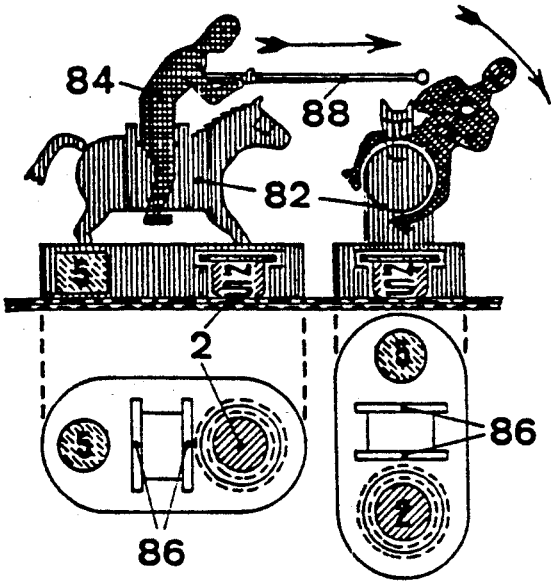
FIG.13a
FIG.13b
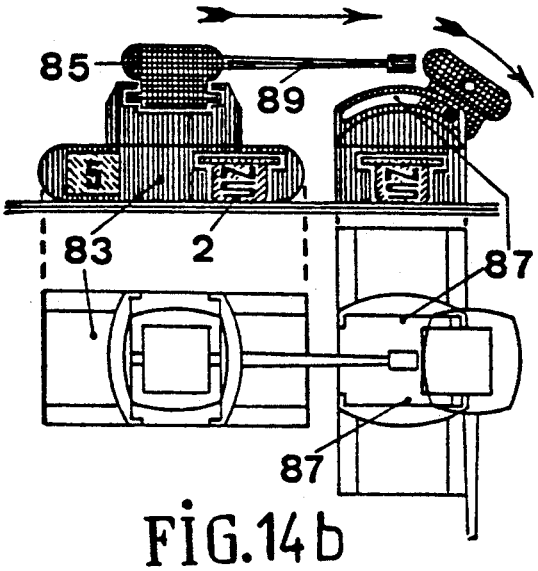
FIG.14a
FIG.14b

GAME WITH MOBILE FIGURES

BACKGROUND OF THE INVENTION

The present invention relates to a game with movable figurines which can move over a board.

The technical field of the invention is that of games and toys with manual controls. The invention relates more particularly to an indoor game in which the players move, via manual control means connected to movable parts by mechanical transmissions situated under the game board, figurines situated above this board.

Numerous game devices in which figurines are moved are already known; the Patents U.S. Pat. No. 2,229,232 (Widegren) and FR 1,395,049 (Parrot) describe apparatuses where the figurines are controlled by alternating link rods which extend beyond the ends of the game and which are thus liable to impede the players and which can furthermore be subjected to impacts leading to serious risks of deterioration of the link rods and thus of these games.

Furthermore, the U.S. Pat Nos. 2,148,354 (Hurlock) and 3,419,271 (Waskowsky) describe game devices where the figurines are attached to alternate belts, which makes it difficult or impossible to move the figurines in a direction other than the direction of the said belts especially in a direction corresponding to the direction of the width of the game, and which also prevent the rotation of these figurines on themselves.

Furthermore the Patents GB 1,051,371 (Cane), U.S. Pat. No. 3,475,028 (Rodorigo) and U.S. Pat. No. 4,691,921 (Takeo Iseki) describe game devices allowing the rotation of the figures on themselves and in which the significant extension of the manual control link rods on the outside of the game are avoided by means of complex electromechanical transmissions, which are liable to bring about a jerky operation and which contribute furthermore to the fragility of these game devices and the need to use an external power supply such as batteries for example.

The problem posed thus consists in providing a game device with movable figurines with manual controls which allow the figurines to be moved on a board in at least one longitudinal direction of the game, enabling the figurines to be moved within longitudinal strips, which device must be a very simple design, which does not necessitate complex electro-mechanical driving means and which does not necessitate a manual maneuvring link rod which extends beyond the frame of these games in an exaggerated way.

SUMMARY OF THE INVENTION

The solution to the problem posed consists in providing a game with movable figurines which can move over a substantially horizontal board, the said game and the said board having a median longitudinal axis and a median transverse axis, the said figurines being able to move within longitudinal strips by virtue of driving means arranged under the plane of the said board, which driving means comprise at least one handle and comprise means for joining to the said figurines, characterized in that the said driving means comprise at least two assemblies which can be moved along a direction parallel to the said median longitudinal axis by players actuating the said handles, and each of the said assemblies comprises at least one longitudinal element, at least one vertical element and at least one transverse element, which longitudinal, vertical and transverse elements are rigid and which elements of one of the said assemblies are connected rigidly together, and in that each of the said assemblies comprises the said handle which protrudes from the lateral longitudinal flanks of the frame of the said game, and the said flanks comprise at least one slot which allows the longitudinal movement of the said assemblies over a distance whose value is close to and somewhat less than half the length of the said frame, and the said frame comprises means for the longitudinal guidance of the said assemblies, for example of the said longitudinal elements of the said assemblies.

Advantageously, the said guidance means comprise longitudinal angle irons which are regularly spaced and which delimit between themselves longitudinal spans (which are placed under the said board and which are preferably situated opposite the said strips which are for example drawn on the said board) in which the said longitudinal elements can slide, and each of the said longitudinal elements is connected by a rear end to the said vertical element, and in each of the said spans there is arranged one of the said longitudinal elements in such a manner that in two adjacent spans, the free ends of the corresponding longitudinal elements can pass each other during the longitudinal movement of the said corresponding assemblies.

Advantageously, the said assembly comprises at least one internal longitudinal link rod which can move in a direction transverse to the said game with respect to an external longitudinal cradle which constitutes the said longitudinal element, which longitudinal link rod is rigidly connected to at least one internal vertical spacing piece which can move in the said transverse direction with respect to an external vertical spacing piece which constitutes the said vertical element, which internal vertical spacing piece is rigidly connected to at least one transverse link rod which can slide in the said transverse direction with respect to an external transverse slide which constitutes the said transverse element, and the said longitudinal link rod carries the said means for joining to the said figurines.

Alternatively, the said assembly comprises at least one rotary joining means which can turn about a substantially vertical axis above the said longitudinal element, under the action of horizontal belts which are set in motion by the said handle via a transverse link rod mounted rotatably with respect to the said transverse element, and vertical belts situated in the said vertical element.

Advantageously, the said vertical elements of the said assemblies which are situated on the same side with respect to the said median transverse axis and which are provided with the said protruding handle on the same side of the said game, are of different length (or height), and each of the said lateral longitudinal flanks of the said frame comprises at least two of the said slots which are superimposed so that the said assemblies can pass each other during their longitudinal movements, and preferably the said assemblies equipped with the shortest of the said vertical elements are equipped with a transverse element which is also shorter.

Advantageously, the said figurines are connected in a removable manner to the said joining means of the said assemblies of the said driving means, and the said board of the said game comprises a game surface covered with an interchangeable removable cover so that the said game allows a competitive sport, a game of strategy, a game such as chess, draughts, go etc. or a show to be simulated.

Advantageously, the said joining means are magnetic, the said board is non-magnetic and the said figurines are each equipped in their base with at least one permanent magnet which can interact with a permanent magnet provided on the said longitudinal element of the said assembly of the said driving means.

Advantageously, the said joining means are mechanical and the base of the said figurines is connected to the said longitudinal element of the said driving means by at least one pivot which can traverse the said board by virtue of slots provided in the latter.

Advantageously, a game according to the invention comprises moreover an assembly of the said figurines which are fixed on a horizontal circular plate comprising a central pivot about which the said horizontal circular plate can rotate, and a free space is provided between the said figurines and the said horizontal circular plate which space may contain a ball allowed to escape under the effect of centrifugal force due to the rotation of the said circular plate, via lateral openings made between the said figurines and the said plate.

Advantageously, the said game comprises moreover figurines or models comprising a superstructure which can tip laterally between transverse guides fixed on the base of the said figurine, which superstructure is capable of tipping during an impact with another of the said figurines during movement of the said figurines on the surface of the said game.

In the apparatus in accordance with the invention, a simple sliding of control knobs along the said slots opening on the two halves of the length of at least one of the two sides of the apparatus, engenders an equivalent movement of the figurines over the useful length of the playing field (delimited between the two goal lines in a game imitating a competitive team sport), whilst a slight movement of the control knobs in a direction perpendicular to the guidance slots allows a similar movement of the figurines in the direction of the width of the game to be obtained. In one variant, a rotation of the control knobs allows the rotation of the figurines on the game surface to be obtained.

The result envisaged by the invention is attained by attaching the figurines, mechanically or magnetically, in isolation or by alignment, to a mechanism comprising three series of elements distributed between three horizontally superimposed stages under the game surface (board), namely:

in an upper stage placed immediately below the game surface: the said horizontal and parallel longitudinal elements whose length does not exceed half the length of the apparatus, and to which there are attached, towards the top, and alternatingly, figurines or models belonging to two teams present;

in an intermediate stage situated below the previous one: the said vertical and parallel elements attaching, in an orthogonal fashion, and by one of their ends, the said longitudinal elements of the upper stage to the said transverse elements, described below, of the lower stage;

in a lower stage situated below the previous one: the said horizontal and parallel transverse elements, having a free end terminated by an external control knob, which knob (or handle) slides along one of the said guidance slots open on one of the halves of the length of at least one of the two sides of the apparatus;

it being specified that, in apparatuses imitating competitive team sports or combat games, the transverse elements have a length shorter than half the width of the apparatus and are distributed, in a symmetrical fashion about the imaginary vertical axis passing through the center of the game, between four sectors delimited by vertical planes passing through the said median axes of the said game.

Of course, the imaginary geometric limits mentioned above are materialized by the limitations imposed on the movements of the movable elements of the apparatus by the guidance and support means attached to the frame.

By virtue of the distribution of the said transmission means on superimposed planes, and by virtue of the subdivision into two or four sectors of the said transverse elements carrying the control knobs, two or four players can manenver their figurines, simultaneously, in alternating lines and over the entire length of the game surface, and without bringing about impacts between the various movable parts of the said driving means situated under the game surface.

The description gives several embodiments which can be distinguished especially by the means used for supporting and guiding the said movable elements in order to keep them constantly parallel to each other during their movements, without which the mechanism would become blocked.

The invention provides for the use of several sorts of figurines combined with suitable joining means which can be for example:

magnetic figurines automatically orientating themselves in the direction of their travel, such as described in the French Patent number 1,144,513 of 23 Mar. 1956 (Leonard);

figurines driven by rotary magnets, such as those described in the U.S. Pat, No. 2,492,423 of 27 Dec. 1949 (Gray);

figurines driven by rotary pivots traversing slots in the game surface, such as those described in the U.S. Pat. No. 2,229,232 of 21 Jan. 1941 (Widegren).

In games necessitating the propulsion of a ball, these figurines can be equipped with a bevelled base similar to that described in the French Patent number 920,246 of 16 Jan. 1940 (Vanlanthen).

Finally, the invention is completed by several original devices which allow one apparatus to be adapted to the specific rules of different sports, games or shows imitated.

BRIEF DESCRIPTION OF THE DRAWINGS

The numerous advantages afforded by the invention will be better understood via the following description which refers to the appended drawings which illustrate, without being in any way limiting, methods for particularizing the figurines game according to the invention.

FIGS. 10*a*, 10*b*, 11*a*, 11*b*, 12*a*, 12*b*, 13*a*, 13*b*, 14*a*, 14*b* illustrate in sectional views and in plan views certain embodiment details of the figurines used with games according to the invention.

DESCRIPTION OF THE PREFERRED EMBODIMENTS

Figure 1:
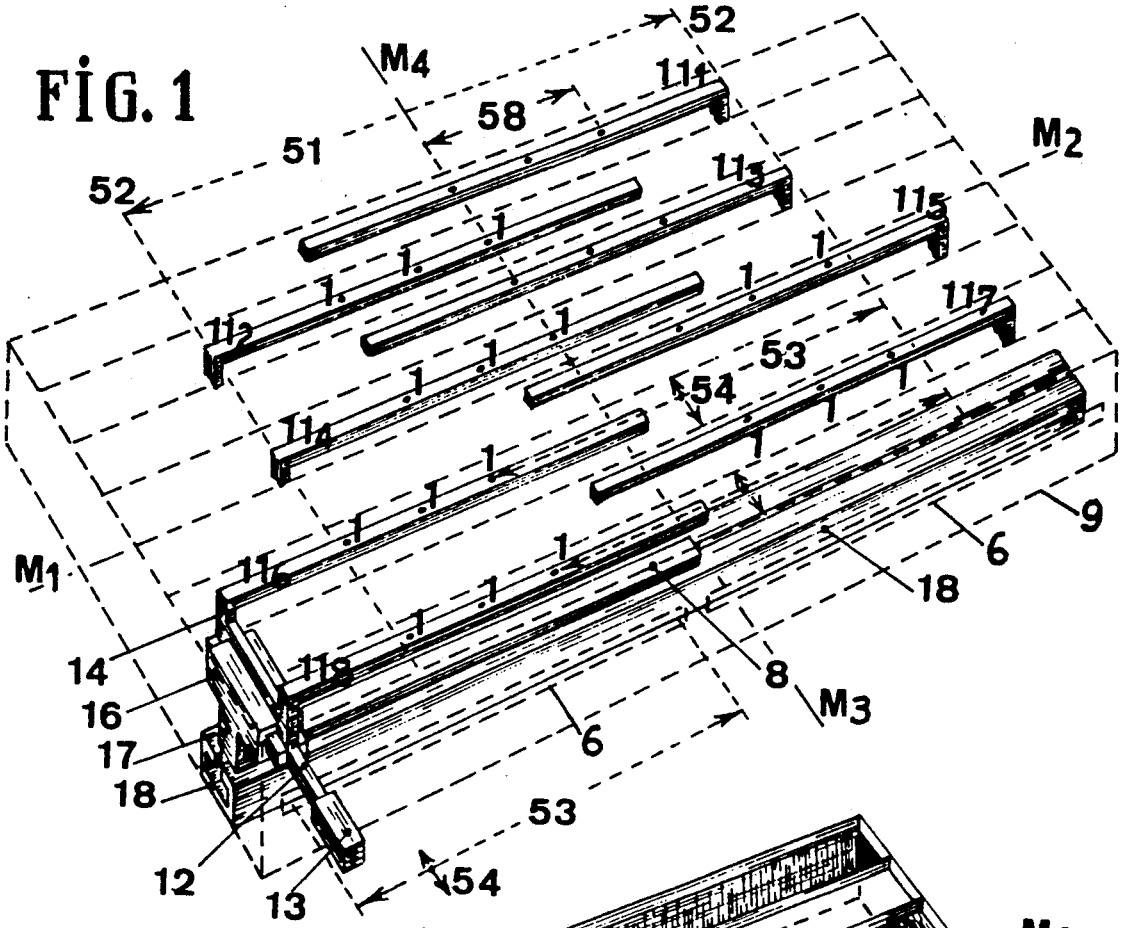
FIG. 1 is a simplified perspective view of a first embodiment of the assembly of driving means according to the invention.

FIG. 1 shows, situated within a frame 9 whose envelope is represented in dotted lines, several driving means of a movable figurines game according to the invention.

To improve the clarity of this figure, only one assembly has been completely drawn, the other assemblies being partially drawn.

In FIG. 1 it can be seen that according to the invention a driving means assembly comprises, in this embodiment, two substantially parallel longitudinal elements 116 and 118, which each comprise on their upper face means 1 for joining to the figurines.

It can be seen that each of the said longitudinal elements 116, 118 is connected via a vertical element 14, in a rigid fashion, to a transverse element 12, which can slide in a transverse slide 16, which transverse slide 16 is itself mounted, in this embodiment, via a second vertical spacing piece 17 on a support which can itself slide within a longitudinal slide 18 which extends substantially over the entire length of the said frame; it can be seen in this figure that the game and the said frame have a median transverse axis M3-M4 and a median longitudinal axis M1-M2. It can also be seen that the said longitudinal elements are parallel and are spaced apart in substantially regular fashion along the said longitudinal direction of the said game.

For reasons of clarity, the said vertical and transverse elements and the corresponding guidance means have been represented only for the assembly described above, which elements and means have not been represented for the other longitudinal elements referenced $11_1$ to $11_5$ and $11_7$ which are represented in this figure.

It will nevertheless be readily understood that in this embodiment, the said longitudinal elements $11_1$ and $11_3$ are themselves connected to a transverse element which can be actuated by a handle situated on the side opposite the game with respect to the observer looking at this figure, likewise that the longitudinal elements $11_2$ and $11_4$ are connected to another transverse element not shown and provided with a control handle also not shown, and likewise that the said longitudinal elements $11_5$ and $11_7$ are themselves connected to a transverse element identical to the said element 12, and connected to a handle identical to the handle 13 and situated on the same side as the latter with respect to the said game; it can be seen that according to the invention and by virtue of the longitudinal sliding means which are provided for each of the said assemblies of the said driving means of the said figurines, each of the said assemblies can slide by virtue of a slot 6 provided in the lateral longitudinal flanks of the said frame which allows the sliding of the said control handle connected to the said transverse element 12 so that, during this movement, the said longitudinal elements can pass each other and so that the figurines which are driven via the said joining means can also pass each other; advantageously, the distance 53 measured along a longitudinal axis of the said game which constitutes the possible travel for the said elements of the said driving means, allows each of the said joining means and thus each of the said figurines to travel a distance which may be approximately equal to half the length of the said game; furthermore, due to the ability of the said transverse element 12 to slide transversely with respect to the said transverse slide 16 which can be carried out over a travel 54 corresponding substantially to the width of the said strips or of the said spans in which the said figurines can move, by virtue of the invention an equivalent movement of these figurines can be obtained.

Figure 2:
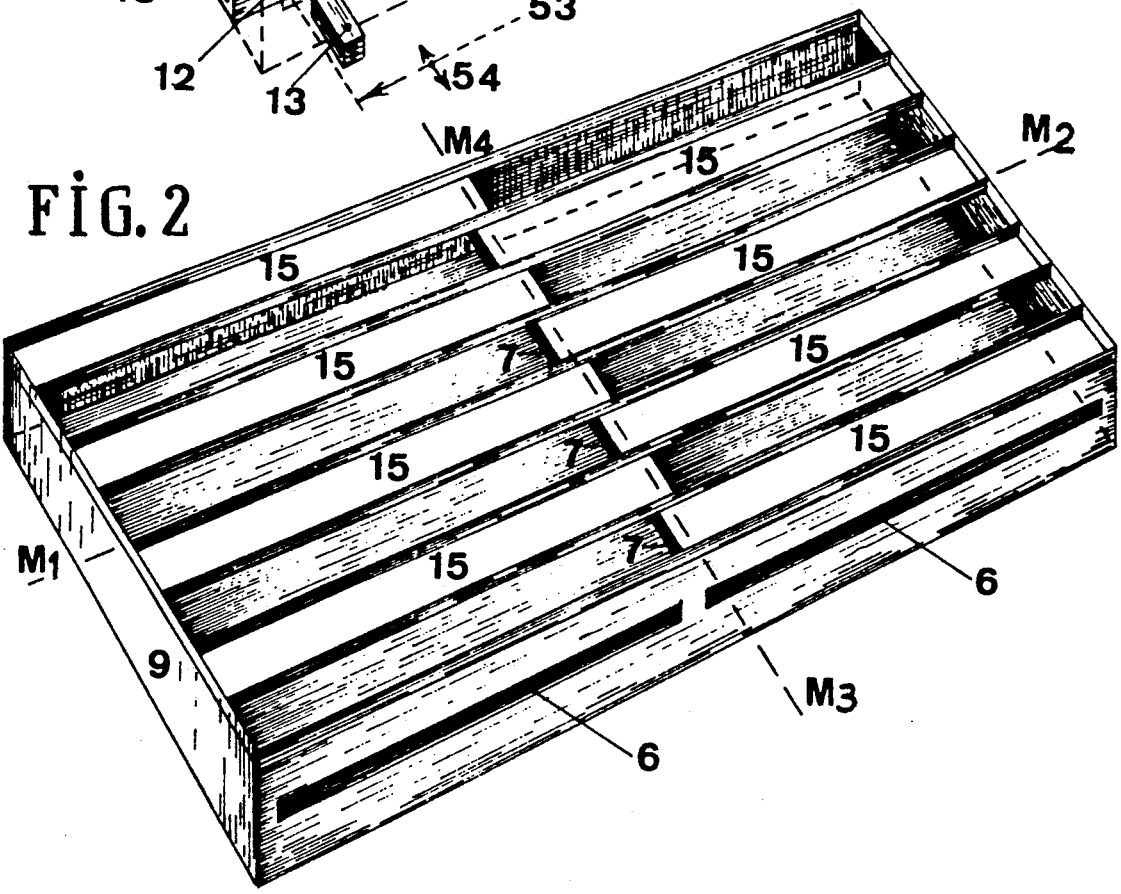
FIG. 2 illustrates by . a perspective view substantially to the same scale as FIG. 1, a frame of a game according to the invention which can be used in interaction with the driving means assemblies of FIG. 1.

In FIG. 2 it can be seen that in the embodiment of the frame 9 corresponding to the elements of the said driving means of FIG. 1, the said frame comprises the said slots 6 made in the said lateral longitudinal walls of the said frame and advantageously comprises a median cross-member 7 upon which there rest the angle irons 15 which advantageously have a U-shaped profile, which extend substantially over a length equal to half the length of the said frame and which have a solid face on their said length and which are arranged in an alternating fashion on either side of the said median transverse axis M3-M4, when moving along the latter.

Figure 3:
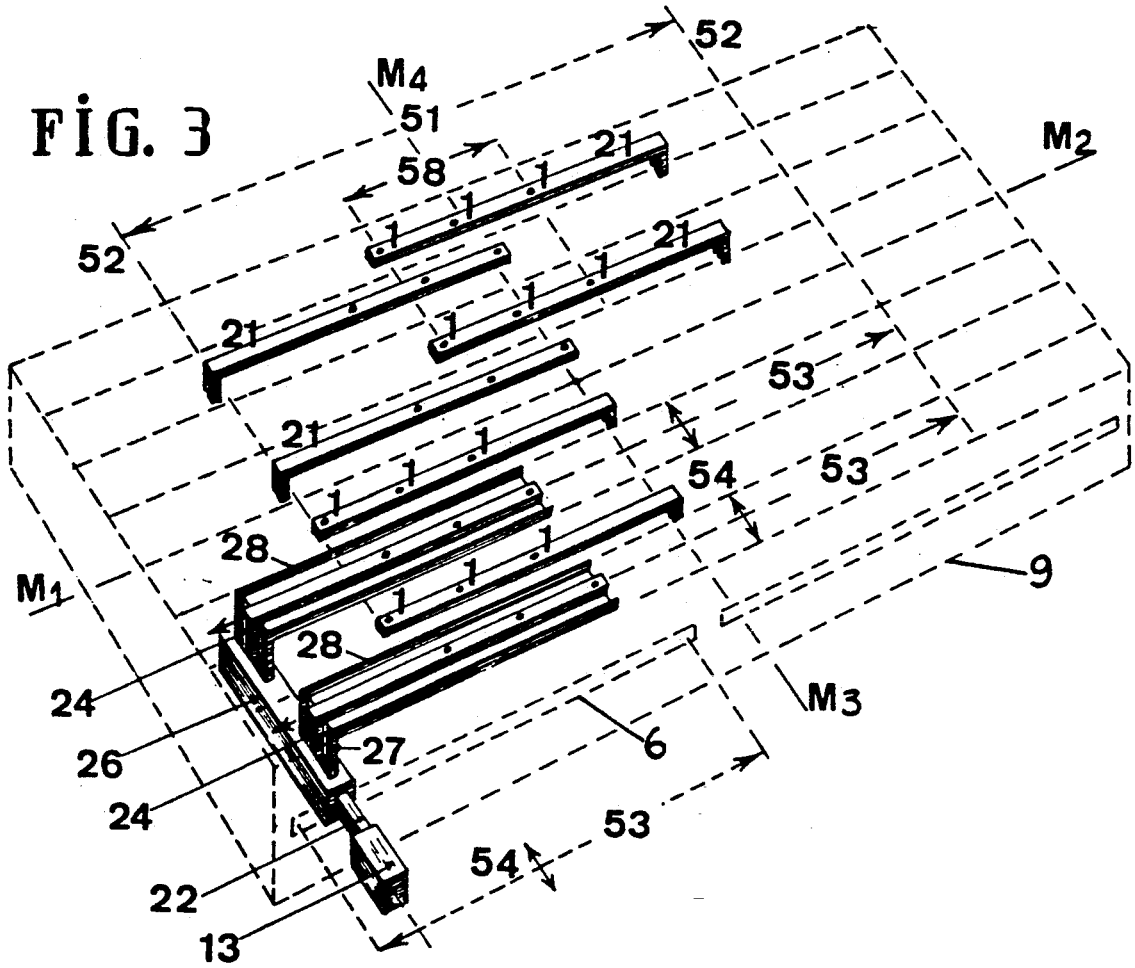
FIG. 3 illustrates in the same fashion as in FIG. 1 a second embodiment of the said driving means assemblies according to the invention.

FIG. 3 shows, in a similar fashion to FIG. 1, another embodiment of the said assemblies of the said driving means; it can be seen that in this embodiment, each of the said assemblies (only one of which is entirely represented in this figure in order to improve the clarity of the latter) comprises the said longitudinal element 28 which is formed by a beam having a basically U-shaped profile and which is connected to a vertical spacing piece 27 which is substantially a beam of the same profile as the said longitudinal element 28; the said vertical element 27 is itself rigidly connected to an external transverse slide 26 which extends parallel to the said median transverse axis M3-M4; in this embodiment, a longitudinal link rod or bar 21 is provided, which can slide transversely within the said U-shaped profile of the said longitudinal element 28, which link rod 21 carries the said joining means 1 allowing the driving of the said figurines, which bar or rail 21 extends along a longitudinal axis parallel to the said axis M1-M2 and is rigidly connected to a vertical bar 24 substantially of the same profile as the said bar 21, which can itself slide transversely in the said profile 27; it can be seen that two of the said vertical bars 24 can be rigidly connected to an internal transverse link rod 22 which can slide transversely within the said transverse slide 26; it can also be seen that a handle 13 is provided at the end of the said transverse link rod so as to allow the manipulation of the said driving means by the said players; the said transverse link rod 22 traverses the said longitudinal lateral faces of the said frame 9 by virtue of the said slots provided in these latter, which allows the movement of the said assemblies of the said figurines driving means over the said longitudinal movement lengths 53 and which also allows the movement of the said bars 21, 24, 22 over a transverse travel 54 with respect to the said elements 28, 27, 26, which allows the movement of the said figurines in the said longitudinal and transverse directions.

Figure 4:
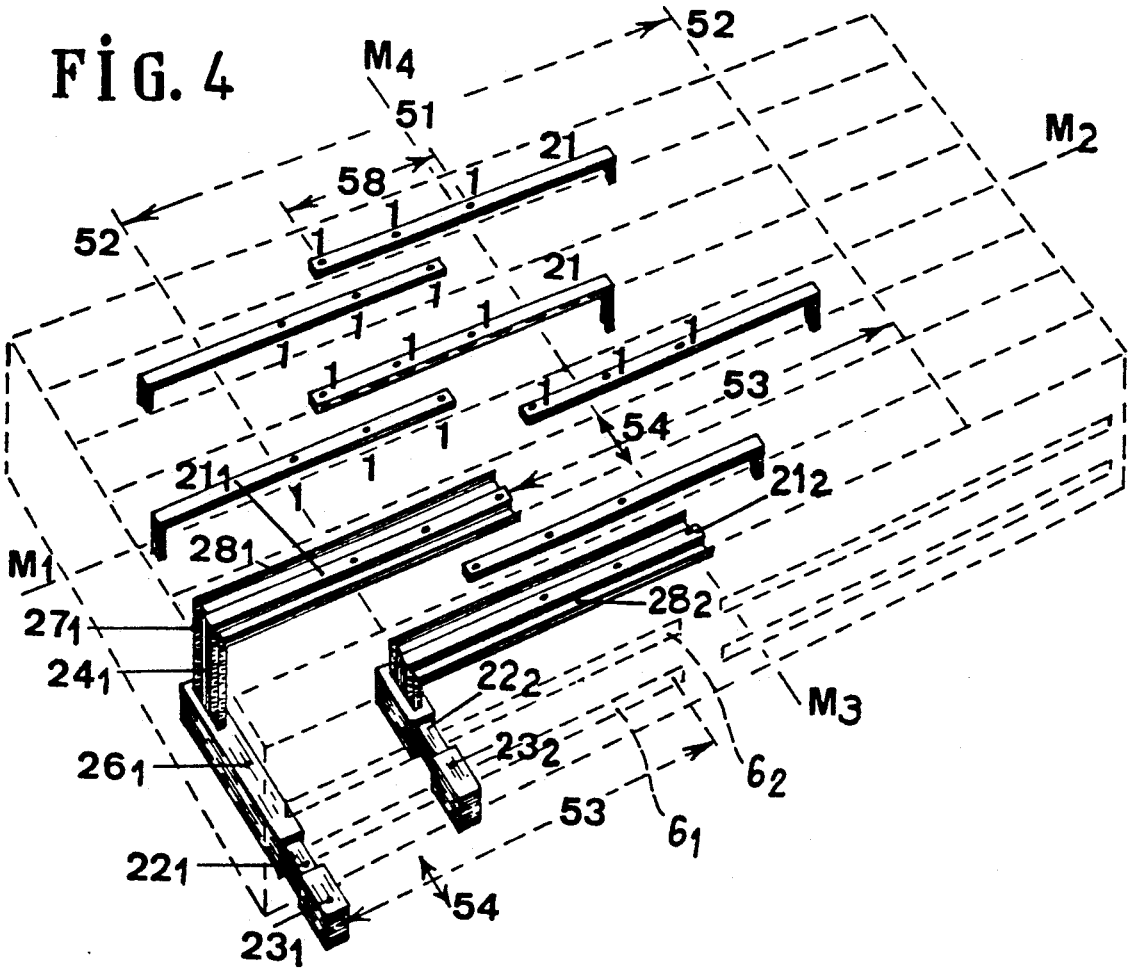
FIG. 4 illustrates in the same fashion as in FIG. 1 a third embodiment of the said driving means assemblies according to the invention.

FIG. 4 represents driving means assemblies according to the invention having a structure similar to those represented in FIG. 3 but in which one single longitudinal bar 21 carrying the said means 1 for joining to the said figurines is associated with each of the said handles 23; it can be seen that in this embodiment, a first driving means assembly comprises the said longitudinal element $28_1$, the said vertical element $27_1$, the said external transverse element $26_1$ and that the said longitudinal bar $21_1$ can slide transversely with respect to the said longitudinal element $28_1$, that the said bar $21_1$ is rigidly connected to the said bar $24_1$ which is connected to the said transverse bar $22_1$, at one end of which the said handle $23_1$ is situated; it can be seen that a second driving means assembly comprising the said handle $23_2$, the said internal transverse link rod $22_2$, and the said longitudinal element $28_2$ in which a longitudinal bar $21_2$ can slide is also provided, the two assemblies of the said driving means described above being situated on the same side of the said median longitudinal axis of the said game, the said vertical and transverse elements of the said two assemblies being of different values, the said assembly equipped with means referenced with an index 1 being equipped with the said vertical and transverse elements of greater dimensions than the said second assembly equipped with means referenced with an index 2 in this figure; it can also be seen that two of the said slots $6_1$ and $6_2$ are provided which respectively allow the passage through the said lateral longitudinal flank of the said frame, of the said transverse rods $22_1$ and $22_2$ and which allow the longitudinal sliding of these rods and of the said corresponding drive means assemblies, and which also allow action on the said driving means by the said handles $23_1$ and $23_2$.

Figure 5:
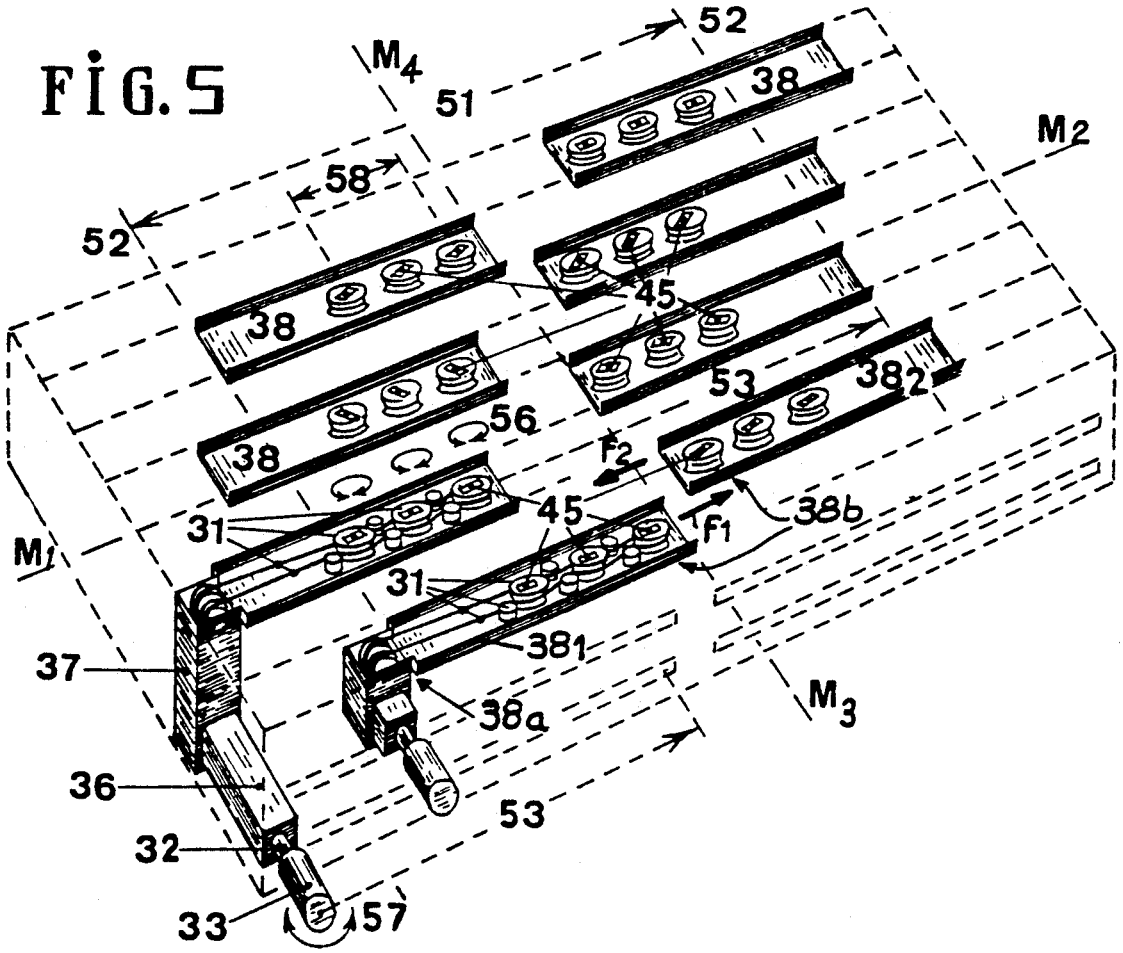
FIG. 5 illustrates in the same fashion as in FIG. 1 a fourth embodiment of the said driving means assemblies according to the invention.

FIG. 5 represents another embodiment of the said assemblies of the said figurines' driving means, in which two assemblies represented in the bottom left of this figure are equipped with vertical and transverse elements of different lengths so as to permit their relative movement and their passing each other during their longitudinal movements, in which the said upper longitudinal element which constitutes a type of cradle 38 is equipped with rotary magnets 45 which are fixed on a support which can rotate with respect to a substantially vertical axis as the arrows in this figure indicate, the said rotary supports 45 being able to be rotationally driven by virtue of substantially horizontal belts 31 extending in a general fashion along the said longitudinal axis of the said game, which belts 31 can be set in motion via return pulleys situated within the said vertical elements here constituted by a hollow external spacing piece 37, of substantially square profile, which belts can also be set in motion by virtue of a rotary handle 33 which can set a rotary transverse link rod 32 in rotation; it can be seen in this figure that each of the said upper elements 38 is rigidly connected by its rear end 38*a* to the said vertical spacing pieces 37, which vertical spacing piece is connected to a transverse slide 36 which partly surrounds at least the said transverse rotary link rod 32, and that the free end 38*b* of the said longitudinal cradles 38 of two assemblies situated in the said adjacent longitudinal spans (or strips), can pass each other during their longitudinal movements in the direction of the arrows F1 and F2.

Figure 6:
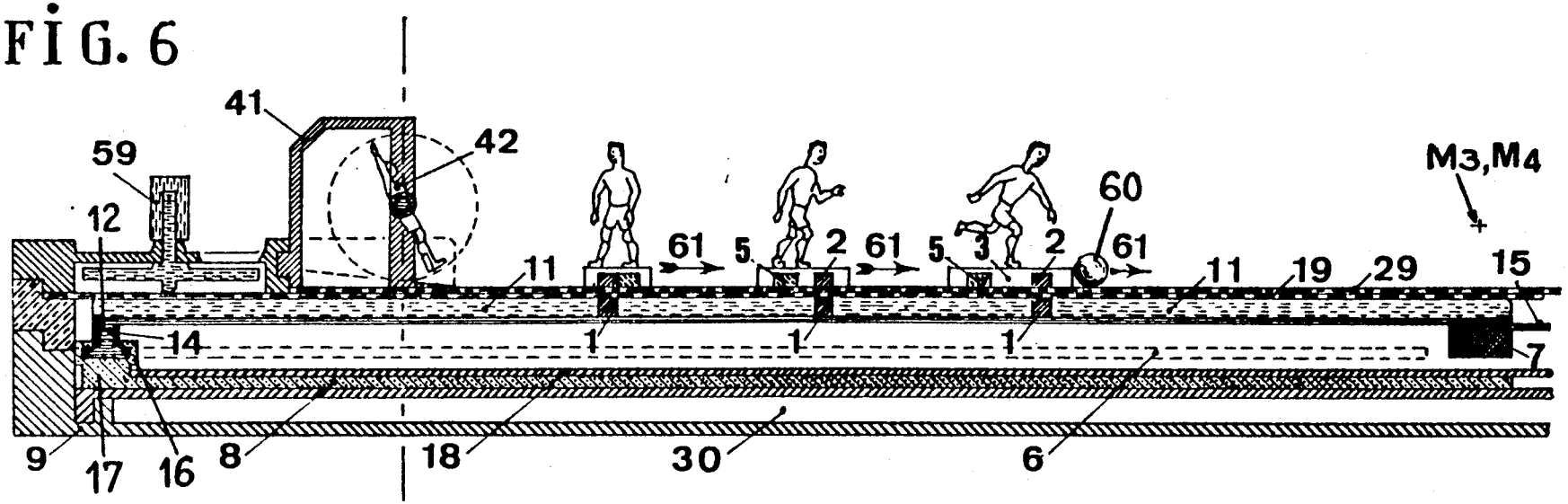
FIG. 6 illustrates in partial longitudinal section a particular embodiment of a game according to the invention.

In the embodiment shown in FIG. 6 and viewed in perspective in FIG. 1, there can be observed:

the longitudinal link rods 11 placed immediately under the non-magnetic game surface 19, and in constant contact with this surface;

the transverse link rods 12, whose external end is terminated by manual control knobs 13;

the vertical link rods 14 connecting, in a rigid and orthogonal fashion, one of the ends of the link rods 11 to the link rods 12;

the permanent magnets 1 flush with the upper face of the link rods 11, and in constant contact with the game surface 19 so as to drive the cylindrical permanent magnets 2 placed on the game surface;

the bases 3 of the figurines, these bases comprising at the front (as illustrated in FIG. 10) a cell in which a magnet 2 retained by a circular collar 4 is freely housed, and comprising at the rear, ballast 5 whose effect is to increase the adherence of the rear face of the base on the game surface; this arrangement having the object of forcing the figurines or models to automatically orientate themselves in the direction of their movement $6_1$ and to do so whilst freely rotating about the drawing magnet 2 in the manner of a trailer about its anchoring pivot according to the arrows $6_2$;

the slots 6 open on each of the sides of the game, and over half the length of the frame 9, for guiding the sliding of the knobs (not shown);

the fixed U-shaped angle irons supporting the movable link rods 11, it being noted that in their starting position represented in FIG. 6, the link rods 11 rest on the angle irons 15 via their free end only;

the median cross-member 7 supporting the fixed angle irons 15, the latter opening under the game surface center line to finish, alternatively, at one or other end of the frame 9.

It is noted that the length of the longitudinal link rods 11 does not exceed half the length of the frame 9 and that, as can be seen in FIG. 1, the length of the transverse link rods 12 does not exceed half the width of this frame.

Furthermore, FIG. 1 also shows that the internal width of the fixed angle irons 15 is at least twice the external width of the longitudinal link rods 11, which allows the latter to move transversely within the longitudinal angle irons 15.

In this arrangement, it is necessary, in order to avoid jamming of the mechanism, to constrain the link rods 11 and also the link rods 12 and 14 to remain constantly parallel to one another during their movements by using, for example, a guidance system comprising:

transverse slides 16 guiding the said transverse link rods 12;

longitudinal slides 18 fixed to the bottom of the frame 9 to serve as guides to the longitudinal jibs 8;

vertical spacing pieces 17 connecting the said slide 16 to the said longitudinal jibs 8.

In this embodiment, the thickness of the said angle irons 15 and of the cross-member 7 determines the minimum height of the vertical link rods 14, which can thus be reduced to extremely short joints, without however being totally eliminated.

Figure 7:
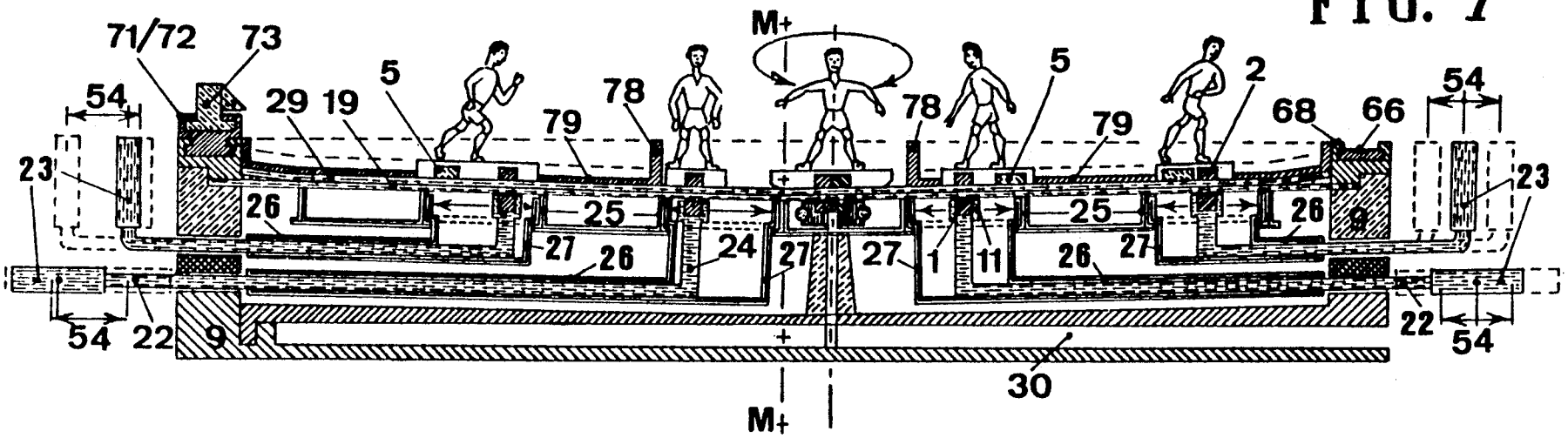
FIG. 7 illustrates in transverse section another embodiment of a game according to the invention.
Figure 9:
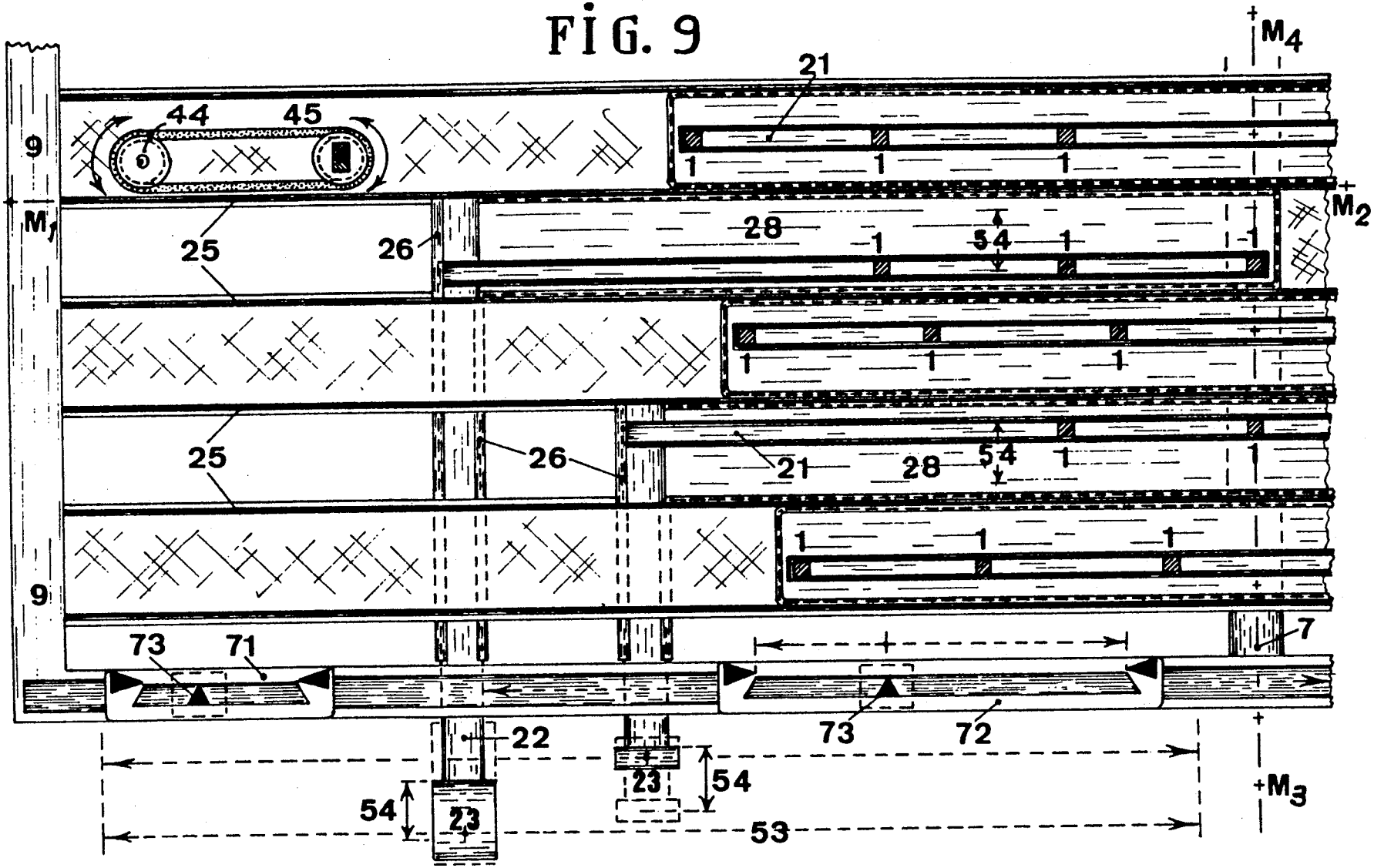
FIG. 9 illustrates in a partial plan view, a particular embodiment of the driving means and of the frame according to the invention.

Furthermore, the absence of any free space under the game surface demands, for imitating a sport requiring a goalkeeper, the use of external goalposts 41 each equipped with a tipping mannequin 42 which can be maneuvered by knobs In another embodiment, which comprises two variants represented in FIG. 4 on the one hand, and FIGS. 7 and 9 on the other hand, it can be observed, in comparison with the first embodiment, that the movable link rods 11, 12 and 14 have each been split as follows:

the longitudinal link rods 11 are replaced by internal link rods 21 allowed to move laterally (transversely) within the longitudinal cradles 28, in the shape of U-shaped angle irons;

the transverse link rods 12 are replaced by internal link rods 22 guided within transverse slides 26;

the vertical link rods 14 are replaced by internal link rods 24 connecting the internal link rods 21 and 22, and by external link rods 27 connecting the cradles 28 to the slides 26.

In this arrangement, the longitudinal cradles 28 slide between fixed inverted T-shaped— or I-shaped—slide angle irons which replace the fixed U-shaped angle irons 15. These angle irons 25 extend over the entire length of the frame 9 and are supported at their middle by the cross-member 7. The fact that the angle irons 25 support the cradles 28 over their entire length makes it possible to substantially reduce the length of the cradles 28 and of the link rods 21, with respect to the length of the link rods 11, so as to place, at each end of the frame, a rotary button 44 controlling either a rotary magnet 45, or a rotary sleeve intended to cause a figurine in the image of a goalkeeper such as that represented in FIG. 11, to turn on itself.

Also, the internal width of the said cradles 28 is at least twice the external width of the said link rods 21, whilst the external width of these cradles 28 is equal to the spacing existing between two of the said fixed angle irons referenced 25 in the contiguous FIGS. 7 and 9.

By virtue of this arrangement, the said movable link rods 22, 26 and 27 are constrained to remain constantly parallel to each other during their movements. This is because the function given to the said slides referenced 16 and 18 in FIG. 6, is fulfilled here respectively, by the said slides 26 and by the said angle irons 25.

This particularity allows, in one variant, all the figurines of each wing of each team to be controlled by a single knob (reference 13 in FIG. 3) and, in a second variant, each line of figurines to be controlled by an individual knob (reference 23 in FIG. 4).

In comparison, the first embodiment (FIG. 1) only allows a grouped control of the figurines of each of the wings of each team.

Figure 8:
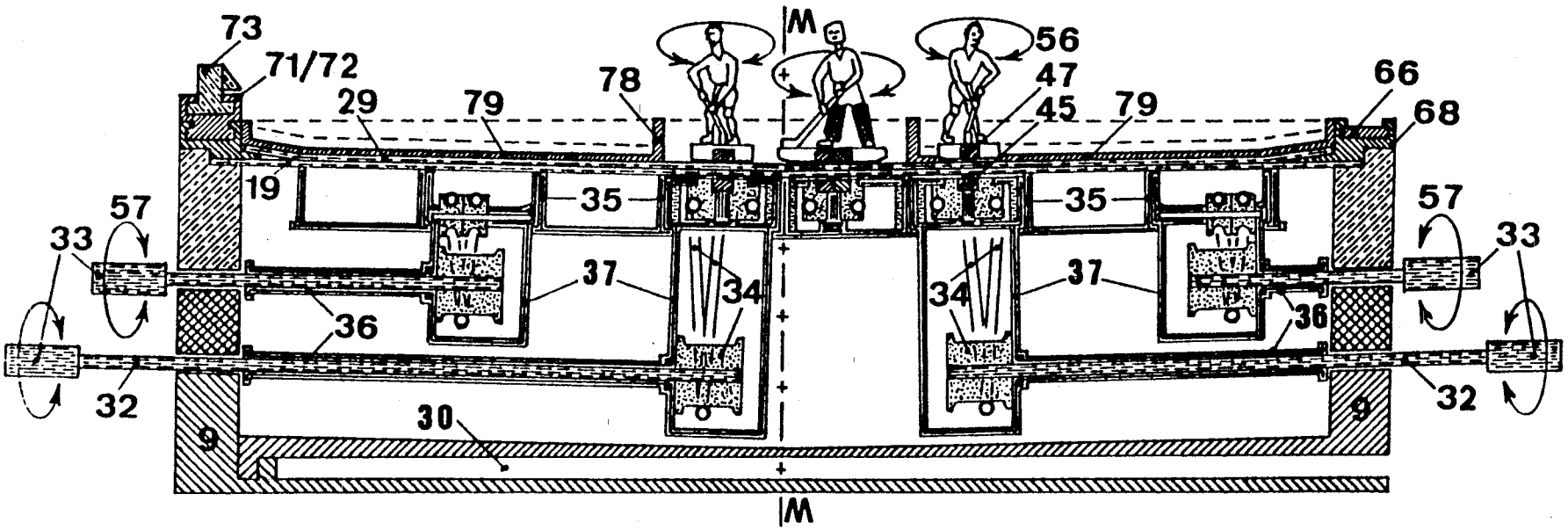
FIG. 8 illustrates in transverse section another embodiment of a game according to the invention.

In the third embodiment of FIG. 8, which is represented in perspective in FIG. 5, it can be observed, by comparison with the embodiment of FIGS. 4, 7 and 9, that the external link rods 26, 27, 28 have been replaced respectively by the said slides 36, the said spacing pieces 37 and the cradles 38, within which there are housed mechanical transmissions such as, especially:

transverse rotary shafts 32 controlled by knobs 33, replacing the sliding link rods 22 controlled by the knobs 23;

double returns of vertical angle comprising either pulley systems with vertical belts 34, or pairs of bevel gears 10 keyed to vertical shafts 20, to replace the link rods 24;

trains of pulleys with horizontal belts 31, replacing the internal longitudinal link rods 21, to bring about the rotation of the magnets (reference 45 in FIG. 5), or female rotary sleeves.

The magnets 45 can equally well be constituted by a single north/south magnet or by two magnets north/south and south/north, joined together (FIG. 11) to drive magnets with complementary poles 47 housed in the bases of the figurines and arranged in their rotational axis.

The rotation and the rectilinear movements of the magnets 45 and 47 on either side of the non-magnetic game surface 19 are facilitated by small cylindrical pads 48 interposed between the said magnets and the game surface, and arranged on the rotational axis of these magnets. This is because, experimentation shows that these pads considerably reduce the braking brought about by the adherence and friction of the magnets 45/47 on either side of the game surface 19.

Of course, the use of female rotary sleeves in which are engaged the pivots 49 of the figurines such as those represented in FIG. 12, requires a game surface 39 cut with slots 40 open over the entire length of the game.

In the embodiments of FIGS. 1, 3, 4 and 5, the longitudinal movement of the said figurines or models over the entire useful length 51 of the game surface lying between the limits 52 is obtained by a simple sliding 53 of the said knobs 13, 23, 33, along the said guidance slots 6.

It is observed that the said useful length 51 is approximately equal to the said length 53 of the said guidance slots 6 augmented by the length 58 of the lines of figurines, which allows the latter to travel the entire length of the playing field represented on the game. The free spaces at each end of the apparatus are occupied by the points counters 59 usually used in this type of game.

In the first embodiments, the lateral movement 54 of the figurines, over the entire width of the longitudinal corridors delimited by the fixed angle irons 15, 25, is obtained by an equivalent transverse movement 54 of the control knobs 13 or 23.

In another embodiment, the lateral movement 54 of the figurines is replaced by a rotation 56 of the figurines on themselves, obtained by means of a rotation 57 of control knobs 33.

FIG. 6 shows how the figurines progress in the direction of the arrows 61, whilst automatically orientating themselves in their direction of travel indicated by the arrows 62, and how the figurines can propel a ball 60 by a succession of passes.

In the apparatuses represented in the drawings, each of the wings of each team comprises two lines each of three magnetic or mechanical joins, but it would be possible to use three or even four lines each of two or three joins. These lines of joins would be controlled either by a single knob, or by two knobs each controlling one or two lines, or by three or four knobs each controlling one single line of joins. In this last case, three or four guidance slots 6 would be superimposed on each of the halves of the sides of the frame 9, which would necessitate preferably an apparatus mounted on legs in the fashion of a billiard table.

Of course, the prescribed number of figurines suitable for each game or sport imitated will be obtained, in apparatuses comprising, for example 12, 16, 18 or 24 joins per team, leaving a certain number of these joins out of use.

It is obvious that figurines such as those represented in FIGS. 10*a*, 10*b*, 11*a*, 11*b* and 12*a*, 12*b* can be produced in the image of various persons, especially football (or rugby, American football, hockey) players, warriors, grenadiers, majorettes, athletes, runners, dancers.

Likewise, models such as those represented in FIGS. 13*a*, 13*b* and 14*a*, 14*b* can also be produced in the image of cars, ships, motorized vehicles, robots, spacecraft, real animals or imaginary monsters . . . .

Generally, known games are designed to simulate a single competition sport, for example football, to the exclusion of any other game. In this case, the fixed game surface (board) 19 or 39 could be directly printed with the prescribed lines of the sport to be imitated.

In order to allow the players to simulate, as desired, any of several games or sports, the invention proposes an apparatus, such as that of FIGS. 6, 7 and 8, in which the fixed game surface 19 or 39, which has no marking or distinctive sign, can be covered by a removable cover 29, these covers being stored in a storage space 30 when not in use.

It is obvious that the non-magnetic game surfaces 19 necessitate non-magnetic removable covers, whilst game surfaces with slots 39 demand removable covers pierced with slots which can be superimposed with the slots 40 of the game surfaces 39.

In indoor games simulating wrestling or combat, the invention provides for the use of two-part models such as those represented in FIGS. 13*a*, 13*b* and 14*a*, 14*b*. These models comprise, for example, an infrastructure 82 (horse) or 83 (tank) and a superstructure 84 (knight) or 85 (turret). The superstructure can tip laterally between transverse guides 86 (saddle) or 87 (turret cradle), these guides, however, preventing any tipping towards the front or towards the rear. In this fashion, the game consists, see FIGS. 13*a*, 13*b* and 14*a*, 14*b*, in maneuvering a model, for example the one on the left, so as to laterally strike the superstructure of an adversary model, the one on the right, by means of the lance 88 or of the gun barrel 89, whose length projects substantially beyond the front end of the infrastructure.

Apparatuses in accordance with the invention can also be used in the manner of puppet theaters, in which the said control knobs and also the said guidance slots will be grouped together on just one side of the said frame.

With respect to the examples represented, this arrangement is equivalent to reducing the apparatus to one of its halves, delimited by a vertical plane passing through the longitudinal median of the game. In this case, the movable elements under the game are no longer arranged symmetrically with respect to a vertical axis passing through the center of the apparatus, but with respect to a vertical plane passing through the transverse median of the game.

Furthermore, in order to produce apparatuses allowing an individual control of each of the lines of figurines belonging to each wing of each team, the mechanism in accordance with the invention allows as many control knobs 23, 33 to be used as is necessary (see FIGS. 4, 5, 7 and 8), these knobs sliding in slots 6 tiered from top to bottom on the sides of the frame 9, in the order in which these lines of figurines are placed from the lateral edge to the longitudinal median of the game surface, which excludes any overlapping between the vertical elements 24, 27, 34 and 37 and the transverse elements 22, 26, 32 and 36, illustrated in FIGS. 4, 5, 7 and 8.

Finally, in order to produce apparatuses simulating American football, the playing field will advantageously be equipped, on one of its sides (as illustrated in FIG. 8), with a graduated rule 66 sliding in a fixed casing 68 to provide a removable numbering of the lines of field; on the other side (as illustrated in FIGS. 8 and 9) with a slide 71/72 carrying an indicating arrow 73 for following the progression of the ball and of the teams during the successive phases of the game.

I claim:

1. A game with movable figurines which can move over a substantially horizontal board mounted on a frame having lateral longitudinal flanks, said board having a median longitudinal axis (M1-M2) and a median transverse axis (M3-M4), each of said figurines being able to move along longitudinal paths by virtue of corresponding driving means arranged under said board, which driving means comprise at least one handle (13,23,33) which protrudes outwardly from one of said frame flanks and further comprise means for joining said driving means to said figurines, wherein said driving means comprise at least two assemblies which can be moved along a direction parallel to said median longitudinal axis by players actuating said handles, and each of said assemblies comprises at least one longitudinal element (11,28, 38), at least one vertical element (14,27,37) and at least one transverse element (12,26,36), which longitudinal, vertical and transverse elements are rigid and are connected rigidly together, and said longitudinal flanks include at least one slot (6) which allows longitudinal movement of said assemblies over a distance (53) whose value is close to and somewhat less than half the length of said frame, and said frame comprises means for the longitudinal guidance of said assemblies.

2. A game according to claim 1, wherein said guidance means comprise longitudinal angle irons (25) which are regularly spaced and which delimit within themselves spans in which said longitudinal elements can slide, said longitudinal elements have first and second ends, each of said longitudinal elements is connected at said first end (38*a*) to said vertical element, and in each of said spans there is arranged one of said longitudinal elements in such a manner that in two adjacent spans, said second ends (38*b*) of corresponding longitudinal elements can pass each other during the longitudinal movement of the corresponding assemblies.

3. A game according to claim 1, wherein each said assembly comprises at least one internal longitudinal link rod (21) which can move in a direction transverse to said longitudinal axis with respect to an external longitudinal cradle which constitutes said longitudinal element (28), which longitudinal link rod is rigidly connected to at least one internal vertical spacing piece (24) which can move in said transverse direction with respect to an external vertical spacing piece which constitutes said vertical element (27), which internal vertical spacing piece is rigidly connected to at least one transverse link rod (22) which can slide in said transverse direction with respect to an external transverse slide which constitutes said transverse element, and said internal longitudinal link rod (21) carries said means for joining to said figurines.

4. A game according to claim 1, wherein each said assembly comprises at least one rotary joining means (45, 46) which can turn about a substantially vertical axis above said longitudinal element, under the action of horizontal belts (31) which are set in motion by said handle via a transverse link rod mounted rotatably (32) with respect to said transverse element, and vertical belts (34) situated in said vertical element (37).

5. A game according to claim 1, wherein said figurines are connected in a removable manner to said joining means of said driving means, and said board of said game comprises a game surface (19) covered with an interchangeable removable cover (29).

6. A game according to claim 1, wherein each of said figurines includes a base, said joining means are magnetic, said board is non-magnetic and said figurines are mounted on respective longitudinal elements and are each equipped in their base (3) with at least one permanent magnet (2) which can interact with a permanent magnet (1) provided on said respective longitudinal elements.

7. A game according to claim 1, wherein each of said figurines includes a base, said joining means are mechanical and the base (3) of each of said figurines is connected to respective longitudinal elements of said driving means by at least one pivot (49) which can traverse said board by virtue of a slot (40) provided in said board.

8. A game according to claim 1, wherein said figurines each comprises a superstructure (84, 85) which can tip laterally between transverse guides (86, 87) fixed on a base of each of said figurines, which superstructure is capable of tipping during an impact with another of the said figurines during movement of said figurines on a surface of said board.

9. A game according to claim 1, wherein a pair of said driving means are situated along the same longitudinal flank of said frame for longitudinal movements of the assemblies of said pair of driving means along overlapping lengths of said frame, the vertical elements of the assemblies of one of said pair of driving means having a different height than the vertical elements of the assemblies of the other of said pair of driving means, said same frame flank including two vertically spaced, longitudinally extending slots, and the handles corresponding to said pair of driving means protrude outwardly through respective ones of said vertically spaced slot whereby said pair of driving means can pass each other during their longitudinal movements.

* * * * *